United States Patent [19]

Cary et al.

[11] 4,260,079

[45] Apr. 7, 1981

[54] MANUALLY OPERATED LIQUID DISPENSERS

[75] Inventors: John R. Cary, Miami Lakes; Walter H. Wesner, Ft. Lauderdale, both of Fla.

[73] Assignee: The AFA Corporation, Miami Lakes, Fla.

[21] Appl. No.: 872,198

[22] Filed: Jan. 25, 1978

Related U.S. Application Data

[63] Continuation-in-part of Ser. No. 754,056, Dec. 23, 1976, abandoned, which is a continuation of Ser. No. 626,819, Oct. 29, 1975, abandoned.

[51] Int. Cl.[2] ..... B05B 11/04

[52] U.S. Cl. ..... 222/209; 222/214

[58] Field of Search ..... 222/209, 212, 383, 205, 222/339, 214, 215, 472, 473; 417/472, 473

[56] References Cited

U.S. PATENT DOCUMENTS

| | | | |
|---|---|---|---|
| 2,738,107 | 3/1956 | Graham | 222/215 |
| 2,764,319 | 9/1956 | Weimer | 222/215 |
| 2,784,882 | 3/1957 | DuBois | 222/215 |
| 2,809,868 | 10/1957 | Thompson | 417/473 X |
| 2,899,110 | 8/1959 | Parker | 222/215 |
| 2,899,901 | 8/1959 | Kosbab | 222/214 X |
| 3,156,383 | 11/1964 | Melli | 222/215 X |
| 3,506,163 | 4/1970 | Rauh et al. | 222/212 |
| 3,529,908 | 9/1970 | Smith | 417/472 |
| 3,650,473 | 3/1972 | Malone | 239/333 |
| 3,685,739 | 8/1972 | Vanier | 239/333 |
| 3,726,442 | 4/1973 | Davidson et al. | 222/207 |
| 3,749,290 | 7/1973 | Micallef | 222/385 |
| 3,780,951 | 12/1973 | Powers | 239/333 |

FOREIGN PATENT DOCUMENTS

| | | | |
|---|---|---|---|
| 571638 | 3/1959 | Canada . | |
| 616864 | 3/1961 | Canada . | |
| 719969 | 10/1965 | Canada | 222/88 |
| 1333491 | 6/1963 | France . | |
| 1393387 | 2/1965 | France . | |
| 2199588 | 4/1974 | France . | |
| 7207668 | 12/1972 | Netherlands . | |
| 939529 | 10/1963 | United Kingdom . | |
| 968290 | 9/1964 | United Kingdom . | |

*Primary Examiner*—Stanley H. Tollberg

*Attorney, Agent, or Firm*—Stanley A. Marcus; Thomas W. Brennan

[57] ABSTRACT

A manually operated dispensing device for a container holding a quantity of liquid is disclosed. The device has a variable volume pump chamber within a component retaining body. The chamber is defined by a bellows having a closed end or bottom, an open end or top, and corrugated sidewalls characterized by their resilience or elastic memory, and fabricated of any of the various thermoplastics. The bellows is associated with a movable member in the form of a trigger which when actuated compressively stresses the bellows in a direction significantly to reduce its length and the volume of the chamber therewithin. When the compression stress applied by the actuating member or trigger is relieved or removed, the bellows regains its original size and shape and returns the actuating member to its initial position. Associated inlet and outlet valves and respective conduits are also incorporated in the device whereby liquid in the liquid container is drawn into the chamber and pumped through a discharge nozzle in the form of a spray, as desired. The alternate application and relief of compressive stress by the trigger or operating member also opens and closes the valves so that liquid can be drawn into the chamber and dispensed therefrom.

22 Claims, 9 Drawing Figures

MANUALLY OPERATED LIQUID DISPENSERS

This is a continuation-in-part of application Ser. No. 754,056, filed Dec. 23, 1976 now abandoned, which, in turn, is a continuation of application Ser. No. 626,819, filed Oct. 29, 1975 now abandoned.

BACKGROUND OF THE INVENTION

1. Field of the Invention

This invention relates to a very low cost manually operated, trigger actuated liquid dispenser featuring a bellows-type pump having multiple flexible wall sections, pleats or corrugations and molded of inexpensive and readily available plastic materials that are inert to the liquid product to be dispensed.

2. Description of the Prior Art

Manually operated, trigger actuated dispensing pumps for liquid dispensers have been proposed in the past. A particular one that has received wide commercial acceptance is disclosed in U.S. Pat. No. 3,061,202, granted Oct. 30, 1962 to Tracy B. Tyler. This type of pump, however, in general, is complex having many parts and is relatively costly to manufacture, inspect and/or assemble. In addition, some of the individual parts are also complex and costly to manufacture, inspect and/or assemble.

Other prior patents have been granted that are directed toward overcoming the problem of costly manufacture inherent in the structure disclosed in the abovementioned U.S. Pat. No. 3,061,202, a particular one being U.S. Pat. No. 3,749,290, granted on July 31, 1973 to Lewis A. Micallef. This patent discloses a trigger sprayer having a deformable, tubular member that defines a pump chamber and is designed to be compressively stressed, and collapsed, on a bulbous sidewall by a trigger mechanism to reduce the pump chamber volume and discharge liquid drawn therein from a container. While this pump embodies but few parts and the manufacturing cost of a dispenser embodying such a pump would be expected to be low, the tubular member, as a practical matter, is so expensive to manufacture as to make the manufacturing cost of a dispenser utilizing such a tubular member prohibitively high in the very competitive market in which such dispensers are sold. Specifically, it has been found that special and hard to obtain materials are required to provide the elastic properties necessary for repetitive collapsing of the bulbous sidewalls upon successive depressions and the return each time when released, to the normal molded condition, while meeting at the same time, the insolubility requirements for the liquid product to be dispensed.

SUMMARY OF THE INVENTION

Among the objects of the present invention is the construction and assembly of an extremely inexpensive, manually operated, trigger actuated dispenser having a pumping container of unitary construction, said dispenser having relatively few parts, each individually simple and inexpensive to manufacture, assemble and inspect, and easily fabricated from readily available materials.

Another object is to provide a device of the foregoing type wherein the liquid is dispensed from a container holding a supply of liquid and upon which the device is mounted, and wherein an outlet or discharge valve is incorporated as an integral part of the unitary pumping container.

A still further object is to provide a device of the foregoing type wherein the components are nearly all comprised of low cost, readily available synthetic materials, preferably elastomeric thermoplastics such as polyolefin, polyurethane, polyvinyl chloride, natural and synthetic rubber and the like.

Still another object of this invention is to provide a manually operated dispensing device of the foregoing type wherein the unitary pump container, in a single part easily moldable from plastics, specifically, a bellows having a number of flexible wall sections, pleats or corrugations, possesses multiple capabilities, combining to perform the functions of a piston, a fluid chamber, a return spring and a valve.

In accomplishing these and other objects there has been provided according to the present invention an improvement in liquid dispensers comprising an integral container pumping mechanism, including valving therefor, in the form of a bellows having a sealed end, an open end, and multiple flexible wall sections, pleats or corrugations that are characterized in their inherent ability to withstand repeated applications of compressive forces that significantly vary the length and enclosed volume of the bellows between a first expanded or rest state and a second compressed or stressed state, with little or no loss of elastic memory. The bellows, in a single part, thus combines the operations of a piston, a fluid chamber, a return spring and a valve, the inherent resilience or elastic memory of the bellows corrugated sidewalls providing a force equivalent to the return spring customarily employed in dispensers. The bellows further features extremely low cost and ease of fabrication, being moldable easily in several configurations of readily available plastic materials by any known process.

DESCRIPTION OF THE PREFERRED EMBODIMENTS

Figure 1:
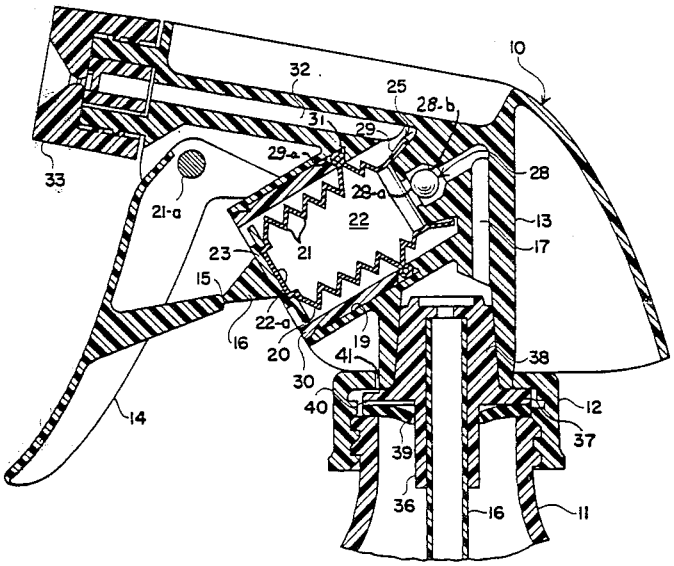
FIG. 1 is a vertical, transverse sectional view of the dispensing device of one embodiment of the invention, before actuation.
Figure 2:
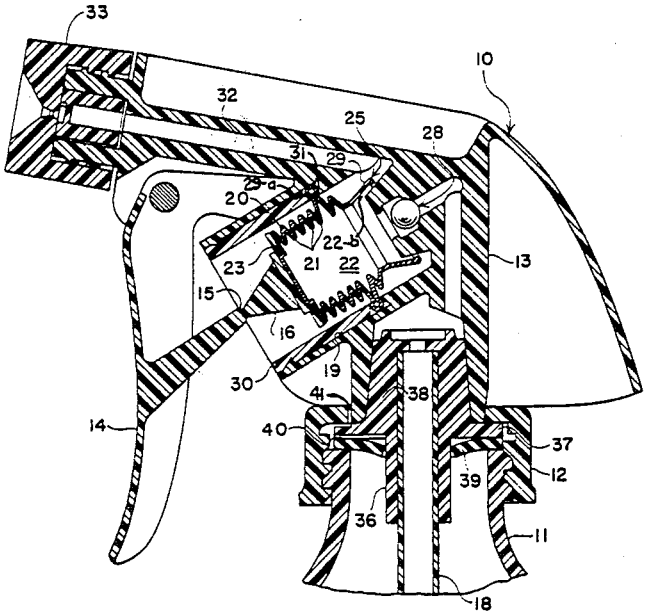
FIG. 2 is a view similar to FIG. 1 after a compressive stress has been applied to the pump container.
Figure 3:
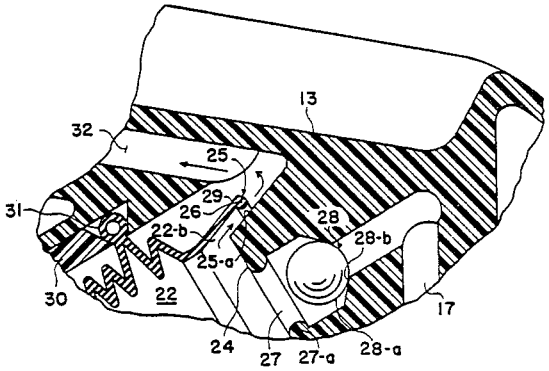
FIG. 3 is a sectional view, on a magnified scale, of the associated valves of the invention embodiment of FIGS. 1 and 2.

Referring now to the structure of the embodiment illustrated in FIGS. 1 through 3, the invention comprises a dispenser 10 threadably secured to a container 11 by a closure cap 12 on the neck of container 11.

Dispenser 10 includes a component retaining body 13 and an operating member or trigger 14 having an extension 16 connected thereto by a plastic, living hinge 15. A cavity 19 in body 13 receives an angularly arranged hollow, resilient compressible pump container or bellows 20 of unitary, blow molded construction, a preferred form being the elastomeric compressible bellows shown. Container pump or bellows 20 has multiple flexible wall sections or corrugations 21 enclosing a variable volume pump chamber 22, and is supported on extension 16 in a recessed platform or plunger 23 thereof. The flexible wall sections or corrugations 21 are characterized by having inherent resilience or elastic memory whereby the bellows pump 20 is able to withstand repeated applications of compressive forces that significantly vary its length and enclosed volume between expanded and compressed states with little or no loss of elastic memory, this inherent memory restoring the bellows pump to its expanded state after having been compressed. Chamber 22 has a closed bottom end **22-*a* and an open top end 22-*b* in a radially extending flared end 29 of container 20**.

Pump or bellows container 20 flared end portion 29, which includes open top **22-*b*, receives in sealing relation an inwardly tapering projection 24 of body 13, on a sealing surface or valve seat 25-*a* of an outlet valve 25. Flared end 29 has an integral rib or lip comprising a movable valve member 26, which operatively combines with valve seat 25-*a* to form outlet valve 25. In FIG. 3, outlet valve 25 is shown in the open or liquid discharging position and, as indicated by the arrows, liquid is flowing therethrough, pump container 20 having been compressed by the folding of its flexible wall corrugations 21 which causes flared end 29 to move downwardly a slight distance thereby separating valve member 26 from seat 25-*a* to open outlet valve 25**.

Tapered body projection 24 has a central passage formed therein terminating in an intake port 27 in open top **22-*b* of chamber 22. Upstreamwardly of intake port 27, retained therein by an annular, radially extending rib or land 27-*a* in intake port 27, is an inlet valve 28 comprising a ball check 28-*a*, and an inlet valve seat 28-*b*. An angled inlet conduit 17 connects chamber 22 through valve 28 to a liquid suction or dip tube 18 which is retained in a body or base insert 38, depending therefrom into container 11**.

As is explained in more detail hereinafter outlet valve 25 and inlet valve 28 are responsive to differences in pressure across them in their opening and closing actions.

Compressible container pump or compressible bellows 20 is retained in body 13 in a circumferential groove or recess **29*a* by means of a press fitted, cylindrical retaining clip 30 in cavity 19 which engages an integral annular collar or clamping ring 31 on pump container or bellows 20**.

A discharge conduit 32 is connected to open top **22-*b* through outlet valve 25, receives liquid being pumped from chamber 20 and conducts the same to a discharge nozzle 33** where the liquid is ejected or dispensed, in a spray if desired.

Also provided in dispenser 10 is a venting means for container 11 to insure pressure equalization therein, comprising a resilient washer vent or ring seal 39 of generally frusto-conical shape, removably secured in cap 12 between the top of container 11 and the flange 37 of body or base insert 38. Vent washer 39, which can be fabricated of any resilient material such as natural or synthetic rubber, polyethylene, polypropylene, or any material capable of maintaining its general form and resiliency, has a central, slightly undersized aperture with respect to the outside of a tube holder or support member 36 of insert 38 with which it is associated as a check valve permitting air to flow into container 11 from above to equalize pressure therein by replacing the liquid which is dispensed while preventing liquid leakage from below. In operation, air passes through a slot 41 in the top of cap 12 and into a passage 40 above ring seal or washer vent 39 and into container 11, since vent 39 will yield by flexing away from the surface of support member 36 to permit outside air to enter container 11 replacing liquid which has been drawn therefrom. On the other hand, liquid in container 11 is prevented from leaking since liquid pressure on the container side of washer vent 39 causes it to close tighter around support 36.

Figure 4:
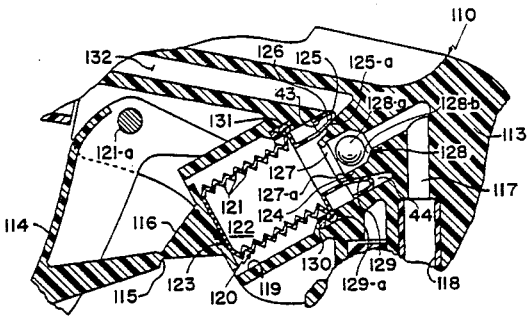
FIG. 4 is a vertical, transverse sectional view illustrating another embodiment of the invention.

Referring now to FIG. 4 there is shown therein another embodiment of the present invention wherein a dispenser 110 comprises a component retaining body 113, a trigger 114 having an extension 116 connected thereto by a plastic hinge 115. A cavity 119 in body 113 contains a unitary pump or bellows container 120 having flexible wall sections or corrugations 121 enclosing a pump chamber 122. Chamber 122 has a closed bottom **122-*a* and an open top 122-*b* and is supported on a platform 123**.

Pump or bellows container 120 has a flared end 129 which includes open top **122-*b* and terminated in an expandable, flexible flange or collar 43. Flange 43 is engaged in a recess 44 in body 113 which is formed by a tapered projection 124 therein. Tapered projection 124 extends into flared end 129, and a portion of its outer peripheral surface 125-*a* provides a seal for a valve 125 when engaged by a valve member 126 on end 129**.

Tapered portion 124 has a central passage terminating in an intake port 127 at the entrance to chamber 122. An inlet valve 128 is retained in the central passage of projection 124 between a rib or land **127-*a* in the entrance of chamber 122 and comprises a ball check 128-*a* and a valve seat 128-*b*. An angled inlet conduit 117 connects chamber 122 to a depending dip tube 118 and a container of liquid (not shown), as in the previously described embodiment of FIG. 1**.

Bellows 120 is retained in body 113 in a recess or groove **129-*a* in cavity 119 by a clip or snap ring 130 which engages a peripheral radially extending clamping ring 131 on bellows pump 120**.

A discharge conduit 132 for conducting liquid from chamber 122 extends from outlet valve 125 to a discharge nozzle (not shown).

Figure 5:
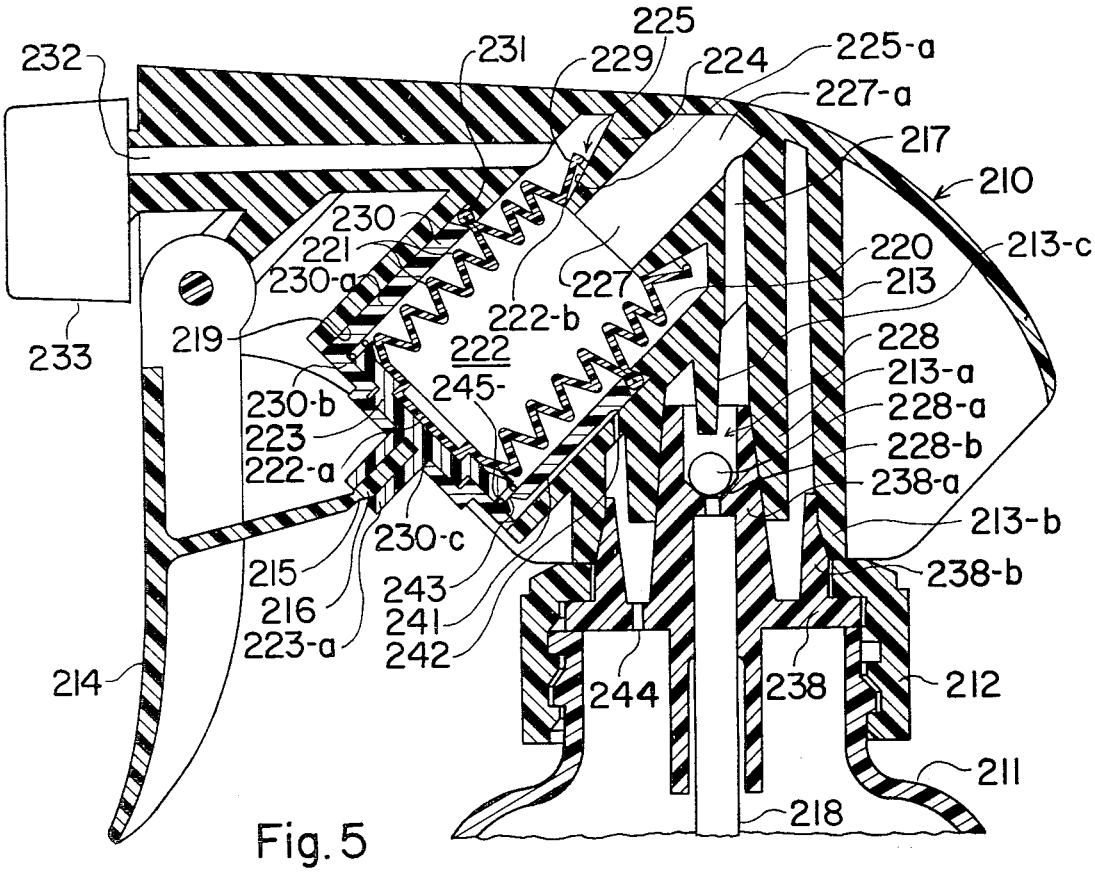
FIG. 5 is a vertical, transverse sectional view of still another embodiment of the invention.

FIG. 5 illustrates a further embodiment of the invention that is generally similar to the previous embodiments described but which includes a different inlet valve arrangement and different structure whereby a manually operated dispenser coupled to a container 211 can vent and also provide a seal for shipping purposes. The dispenser 210 of FIG. 5 comprises a component retaining body 213, a trigger 214 having an extension 216 connected thereto by a plastic hinge 215. A cavity 219 in body 213 contains a unitary pump or bellows container 220 having flexible wall sections, pleats or corrugations 221 enclosing a variable volume pump chamber 222. Chamber 222 has a closed bottom **222-*a* and an open top 222-*b* and is supported on a circular disc 223 having an outwardly extending projection 223**-*a* to which extension 216 of trigger 214 is attached.

Pump or bellows container 220, has a flared end 229 which includes the open top 222-*b*. The flared end 229 receives in sealing relation an inwardly tapering projection 224 of body 213 on a sealing surface or valve seat 225-*a* of an outlet valve 225. Valve 225 may be similar in construction and operation to the outlet valve 25 of FIGS. 1 to 3.

Tapered body projection 224 has a central passage 227-*a* therein terminating in an intake port 227 in open top 222-*b* of chamber 222. Upstreamwardly of the intake port 227 the central passage 227-*a* connects to an inlet conduit 217 which terminates at the upper end of a body or base insert 238 that is captured in sealing manner by cap 212 to the top of container 211. Base insert 238 includes concentrically arranged inwardly tapering projections 238-*a* and 238-*b* that are received in sealing relation in corresponding concentrically arranged but outwardly tapering openings 213-*a* and 213-*b* in component body 213. A liquid suction or dip tube 218 is retained in insert 238 and is in communication with conduit 217. An inlet valve 228 having a ball check valve 228-*a* and an inlet valve seat 228-*b* are provided adjacent the upper end of the dip tube 218, a projection 213-*c* of body 213 being provided to retain ball check valve 228-*a* close to its operative position.

A discharge conduit 232 connected to open top 222-*b* through outlet valve 225 and receiving liquid pumped from chamber 222 conducts the same to a discharge nozzle 233 where the liquid is ejected or dispensed, in a spray, if desired.

Compressible container pump or compressible bellows 220 is retained in cavity 219 in body 213 by means of a press fitted, cylindrical retaining sleeve 230-*a* of a cup 230 having a bottom 230-*b* in which a slot 230-*c* is provided. The upper edge of sleeve 230-*a* engages an integral collar or clamping ring 231 on pump container or bellows 220. Projection 223-*a* of disc 223 fits through a slot 230-*c* and is free to slide therein as trigger 214 is actuated. Disc 223 is snugly received in cup 230, in sliding engagement with the cylindrical inner wall thereof.

The means for providing venting of the container 211 of the FIG. 5 invention embodiment includes an L-shaped groove 241 provided in the outer wall 230-*a* of cup 230. Groove 241 connects with an opening 242 in body 213 at its inner upper end, and with the atmosphere at its outer lower end. With the pump container or bellows 220 in its elongated non-pumping or rest position the opening 243 at the outer lower end of groove 241 is covered in a sealing manner by the edge of disc 223 to prevent air and liquid passage to the atmosphere. When trigger 214 is pulled, disc 223 moves inward off the opening 243 of groove 241. With the groove 241 unrestricted, there is a clear passage from the atmosphere through the groove 241 through opening 242 and down through an opening 244 in insert 238 into container 211. This passage allows air to flow into container 211 on each stroke of the trigger 214 and bellows 220 from their rest positions. Desirably, to provide a seal between the edge disc 223 and the inner wall of sleeve 230*a*, parallel tapered flexible rings 245 are molded on the circumference of disc 223 to straddle opening 243. The disc 223 preferably is molded of a common polymer such as polypropylene or polyethylene to obtain the proper flex on rings 245, thereby allowing a slidable seal with low friction.

Refer now to the embodiment of FIGS. 6 through 9 for a description of another form of the invention that generally is similar to the invention embodiments of FIGS. 1 through 5, but which employs a different valving arrangement and in which the pump container or bellows is positioned vertically instead of at an angle with respect to the dispenser as in the previous embodiments. The dispenser 310 of this embodiment is adapted to be secured to the neck of a container, not shown, by a closure cap 312 and includes a component retaining body 313, shroud 311, and an operating member or trigger 314. Trigger 314 has a plate-like extension 316 and is pivoted by a pin connector 315 to the body 313. A cavity 319 in body 313 is closed by shroud 311 and receives therein a vertically arranged pump container or bellows 320 having a closed end 320-*a* and an open end 320-*b*.

The construction of the flexible wall sections or corrugations of the bellows 320 desirably is the same as that of the pump container or bellows of the invention embodiments previously described. The bellows 320, however, is characterized in having provided at its open end 320-*b* an integral outwardly extending flexible flange 320-*c* that is clamped between the shroud 311 and the body 313 at the upper end of the cavity 319. Additionally, formed at the opposite sides of flange 320-*c* are slit-like apertures 325-*a* and 328-*a*, respectively.

Shroud 311 and bellows 320 enclose a variable volume pump chamber 322. Bellows 320 is supported at its closed end 320-*a* on the upper edge 316-*a* of trigger extension 316, engaging a slot in a disc 323 that is formed by the closed end 320-*a* of the bellows. Desirably, the extension 316 is suitably curved, as shown, to ensure a uniform application of upward force to the bellows 320 during the compressive strokes thereof, as the trigger 314 is operated. The lower edge 316-*b* of trigger extension 316 is provided with a projection 316-*c* that, in the elongated non-pumping or rest position of bellows 320, is received in a sealing manner in an opening or slot 313-*b* provided in a ledge portion 313-*a* of component body 313. With the bellows 320 under some small compressive stress in the rest position the trigger 314 is firmly held in position while in its non-pumping position to seal opening 313-*b*. Opening 313-*b*, however, is opened on each trigger pumping stroke to vent the container.

Figure 7:
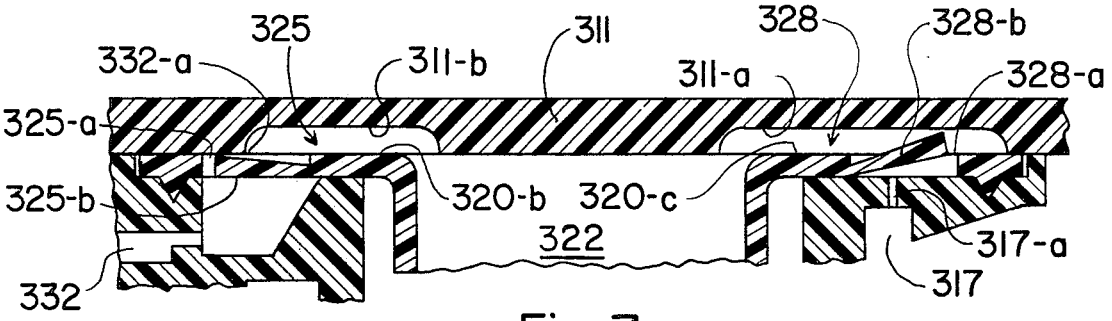
FIG. 7 is a section through the pump mechanism of FIG. 6, taken in the same plane but with parts broken away, and with the deflectable valve elements in positions assumed during the expansion or suction stroke.
Figure 8:
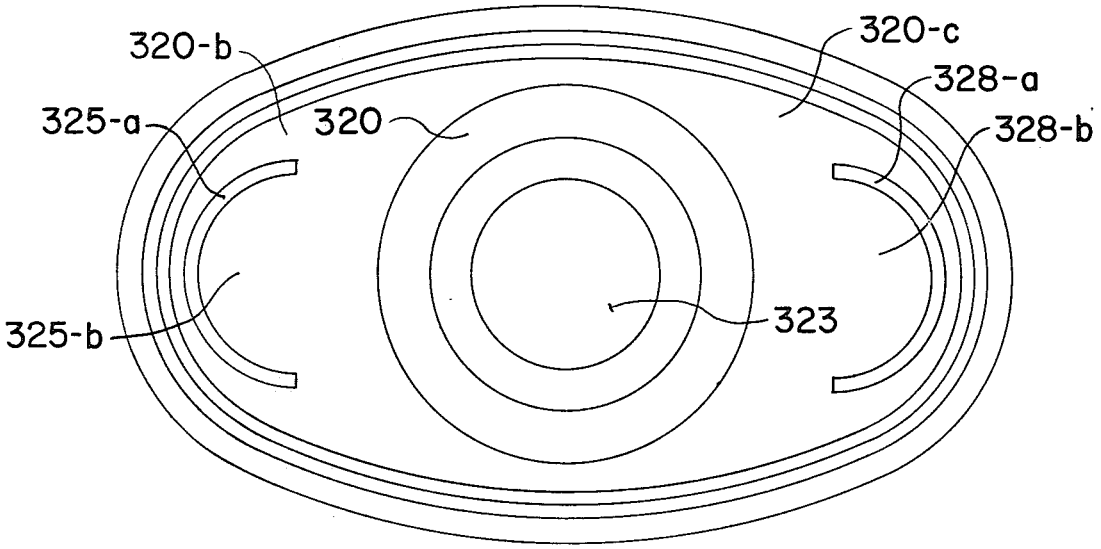
FIG. 8 is bottom plan view of the pumping bellows of FIG. 6.
Figure 9:
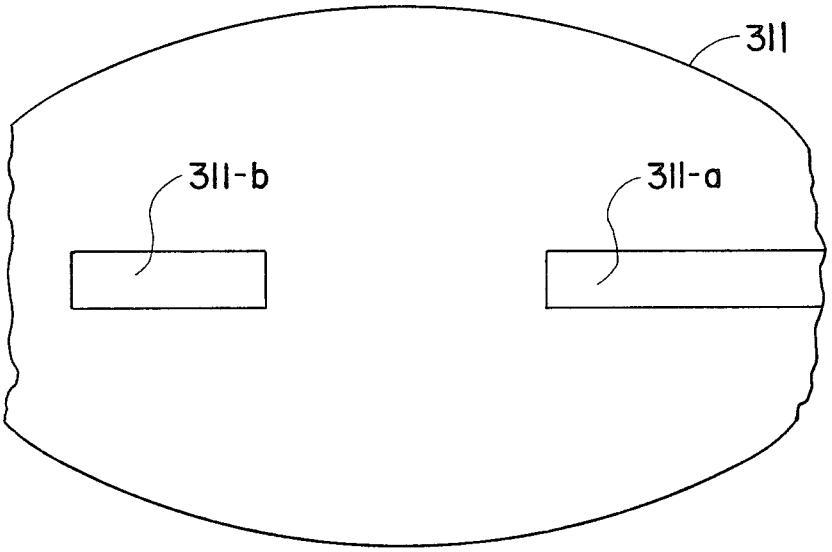
FIG. 9 is a bottom plan view of the cover member of FIG. 6.

An inlet conduit 317 connects the variable volume chamber 322 through an inlet valve 328 to a liquid suction or dip tube 318 which is retained in body 313. Body 313 is forcibly joined to a collar 333 that is captured in a sealing manner to the neck of a container, not shown, by cap 312. As best seen in FIG. 7, the inlet conduit terminates in an upwardly directed inlet port 317-*a* that is located beneath aperture 328-*a* of flange 320-*c*. Aperture 328-*a* defines a deflectable valve element or flap 328-*b* of an inlet valve 328 that normally seats over and closes in a sealing manner the inlet port 317-*a* but which is unseated to open inlet valve 328 when the liquid pressure in the port 317-*a* is greater than that in chamber 322, as occurs during each suction stroke of pump container or bellows 320. Inlet valve 328 thus is a differential pressure sensing valve, and when opened, admits liquid from the conduit 317 through the aperture 328-*a* to a recess or groove 311-*a* provided in the lower surface of the shroud 311 and from there the liquid flows to the chamber 322. The groove 311-*a* is located above and substantially in registry with the valve element or flap 328-*b* and provides space sufficient for upward deflection and unseating of the valve element or flap 328-*b* on each expansive stroke of bellows 320.

A discharge conduit 332 is connected to the variable volume pump chamber 322 through an outlet valve 325 and receives liquid pumped from chamber 322. Conduit 332 conducts the liquid to a discharge nozzle 333 where the liquid is dispensed, in a spray, if desired. The outlet valve 325 includes a valve element or flap deformable portion 325-*b* that cooperates with an outlet port 332-*a*. The outlet port 332-*a* is formed by a recess or groove 311-*b* in the lower surface of the shroud 311. Groove 311-*b* communicates with the pump chamber 322 and extends outwardly with respect to flange 320-*b* towards the aperture 325-*a*. Aperture 325-*a* defines a deflectable valve element or flap portion 325-*b* of outlet valve 325. The outer end of groove 311-*b* is normally closed by the seating of valve element 325-*b* in a sealing manner over the groove 311-*b* and over the lower surface of shroud 311. Valve element 325-*b* is unseated, however, when the liquid pressure in the chamber 322 is greater than that in conduit 332 as occurs during each pumping or compressive stroke of the pump container or bellows 320. Outlet valve 325, similarly to inlet valve 328, thus is responsive to differential pressure differences across it in its opening and closing operations. When opened, outlet valve 325 admits liquid to the conduit 332 for discharge, as previously described, through the discharge nozzle 333.

Figure 6:
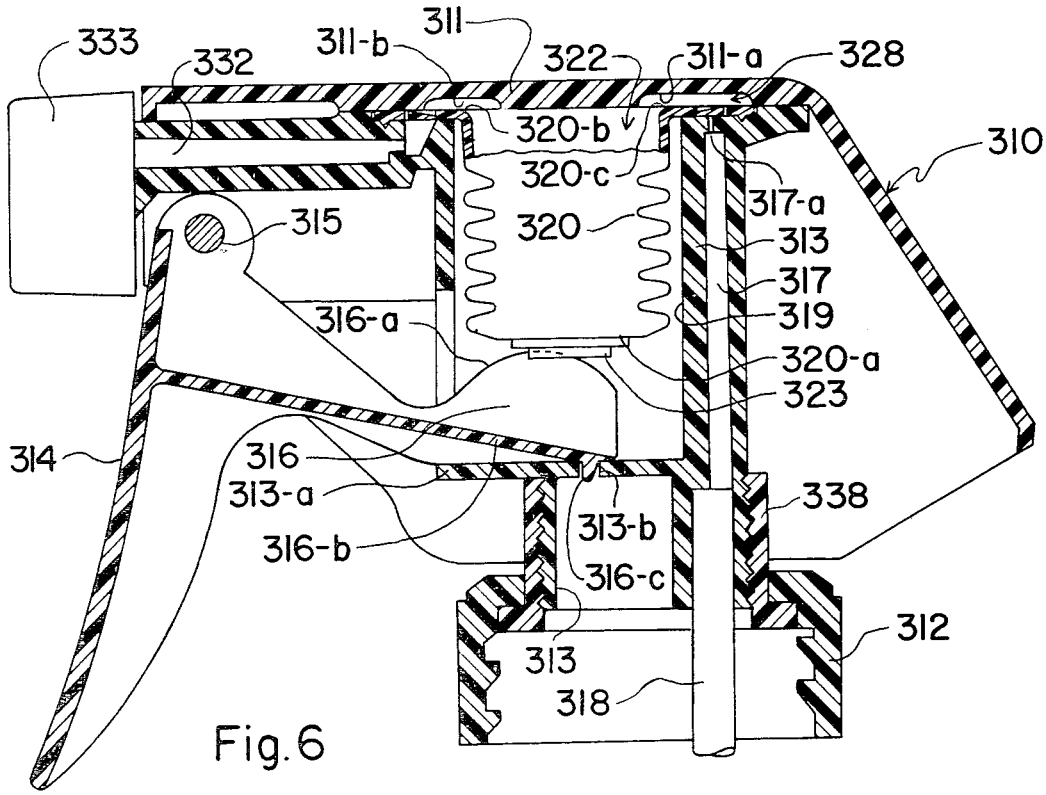
FIG. 6 is a vertical, transverse sectional view of a further embodiment of the invention.

It will be understood that in FIG. 6, venting means and sealing means similar to those shown in FIGS. 1, and 2 may be provided, if desired, in lieu of the venting means shown in FIG. 6.

OPERATION OF THE PREFERRED EMBODIMENTS

Embodiment of FIGS. 1 through 3

In the operation of the present invention, dispenser 10 is attached to container 11 by screwing closure cap 12 onto the neck of container 11. An operator of the invention holds assembled dispenser 10 in the hand, fingers grasping trigger 14 and closure cap 12 in the palm and container 11 extending below the hand. Trigger 14 is forcibly actuated by a squeezing action which forces trigger tension 16 and recessed platform 23 on hinge 15 against bottom 22-*a* of bellows pump 20 applying a compressive stress thereupon. Bellows pump 20 then compresses by folding of flexible wall corrugation or pleats 21 as shown in FIG. 2. Initially, only air is present in chamber 22. As container pump or bellows 20 compresses, the volume of chamber 22 is decreased and pressure is generated in the chamber, making the chamber pressure greater than that in inlet conduit 17 and in outlet conduit 32. Thus pressure difference forces intake ball check valve 28-*a* against seat 28-*b* thereby closing inlet valve 28. Simultaneously, the higher pressure in chamber 22 forces outlet valve 25 to open. Additionally, since pump container 20, in being compressed, suffers a length reduction as both ends move longitudinally toward stationary clamping ring 31, flared end 29 flexing downwardly over projection 24 until valve member 26 and valve seat 25-*a* can no longer remain in contact, thereby further opening the outlet valve 25. Air in chamber 22 thus is forced through open valve 25 into outlet conduit 32 and is ejected through nozzle 33. Upon release of trigger 14, the inherent "memory" of elastomeric flexible wall sections or corrugations 21 of pump container or bellows 20 causes the latter to expand and elongate to its original, expanded configuration, at the same time returning trigger 14 to its original position shown in FIG. 1, pivoting on a pin connector 21-*a* in body 13. This return action results in a partial vacuum being developed in chamber 22, that is, a reduction in pressure below the atmospheric or ambient pressure, closing outlet valve 25, opening inlet valve 28, and causing liquid to be drawn into chamber 22 from container 11 through dip tube 18, conduit 17, open inlet valve 28 and intake port 27, filling chamber 22 with a charge of liquid to be dispensed.

On the next and subsequent squeezing operations of trigger 14, the liquid in chamber 22 becomes pressurized by the compressively stressed, compressing bellows pump 20 which forces inlet ball check 28-*a* against seat 28-*b* closing inlet valve 28, opening outlet valve 25 by the flexing displacement of bellows 20, above described, and permitting liquid to flow into discharge conduit 32 and be dispensed from nozzle 33.

During the above described pumping and dispensing operation of dispenser 10, the liquid level in container 11 is lowered as liquid is dispensed or sprayed. This causes a partial vacuum to develope in container 11 unless venting thereof is provided. In the embodiment of FIGS. 1 through 3, venting is accomplished by means of flexible vent washer or ring seal 39. Atmospheric pressure acting on ring seal 39 causes it to flex downwardly away from support 36. Air passes into passage 40 around the threaded cup 12 and threaded container 11 top and into container 11 through the opening between support 36 and vent valve 39. If venting were not provided for, that is, if atmospheric pressure were not maintained in container 11, if a plastic bottle, for example, container 11 would have a tendency to collapse and additionally, pumping efficiency would be impaired. However, by means of vent valve or washer 39 in cap 12, this eventuality is avoided. In addition, venting washer or ring seal 39 which flexes downwardly to permit air passage into container 11, also provides a tight seal against liquid leakage from container 11, since any liquid from container 11 acts on the underside of ring seal 39 and forces it against support 36, tightly sealing container 11 against leakage.

Embodiment of FIG. 4

To operate the dispenser 110 of FIG. 4 trigger 114 is moved toward the right and compressible bellows 120 is initially compressed closing valve 128 by forcing ball check 128-*a* against seat 128-*b*. Trapped air in chamber 122 increases in pressure and causes flange 43 to expand radially opening outlet valve 25 by causing valve member 126 to separate from seat or seal surface 125. When trigger 114 is released bellows 120 expands or elongates under its inherent memory to its original fully extended configuration. This elongation creates a suction or partial vacuum in chamber 122 which causes valve member 126 to reseat on surface 125-*a* closing outlet vlave 125. Simultaneously, ball check 128-*a* is unseated, leaving seat 128-*b*, inlet valve 128 opens and liquid is drawn up into chamber 122 from container 11 through dip tube 118 and intake conduit 117. The next compressive stroke on bellows 120 by movement of trigger 114 closes valve 128 and expands flange 43 to open valve 125 and liquid in chamber 122 flows into exit conduit 132 to be dispensed from sprayer 110. Subsequent trigger 114 actuations result in alternate suctions and pressurizations to occur in chamber 120 and liquid can be dispensed in a steady stream, or in a spray, as desired.

Embodiment of FIG. 5

The operation of the dispenser 210 of FIG. 5, except for the venting provisions and the location of the inlet valve, is generally similar to that of the embodiment of FIGS. 1 through 3. Thus, movement of trigger 214 to the right compresses pump container or bellows 220 and closes valve 228 by forcing ball check 228-*a* against seat 228-*b*. Trapped air in chamber 222 increases in pressure and causes outlet valve 225 to open. Air in chamber 222 then passes through valve 225 into outlet conduit 232 and is ejected through nozzle 233. With the release of trigger 214, the bellows 220 expands to its original, elongated state, producing a partial vacuum in chamber 222, closing outlet valve 225, opening inlet valve 228, causing liquid to be drawn from a container 211 into chamber 222 and filling the chamber with a charge of liquid to be dispensed. On the next and subsequent actuations of trigger 214, the liquid in chamber 222 becomes pressurized by the compressively stressed bellows 220 which forces valve 228 to close, opens outlet valve 225 by the flexing displacement of bellows 220 and forces liquid through the discharge conduit 232 for ejection from the nozzle 233. Upon each such actuation of trigger 214 the inward movement of the disc 223 off the opening 243 of groove 241 permits air to flow into container 211 thereby venting the latter.

Embodiment of FIGS. 6 through 9

The operation of the dispenser 210 of FIGS. 6 through 9, except for the specific operation of the inlet and outlet valving means provided is generally similar to that of the invention embodiments previously described. Upon initial forcible actuation of trigger 314 to the right, container pump or bellows 320 is compressed to close valve 328 by forcing valve element 328-*b* to seal over inlet port 317-*a*. Air trapped in chamber 322 increases in pressure and causes outlet valve 325 to open, the compressed air then passing through valve 325 into outlet conduit 332 for ejection through nozzle 333. When trigger 314 is released the inherent memory of the wall sections or corrugations of the bellows 320 causes the latter to expand to its original, expanded state. This produces a partial vacuum in chamber 322 which causes valve element 328-*b* to become unseated to open valve 328 and thereby cause liquid to be drawn up through the dip tube 318 into chamber 322. The liquid in chamber 322, on the next and subsequent actuations of trigger 314 becomes pressurized by the compressively stressed bellows 320 which forces outlet valve 325 to open by the unseating of valve element 325-*b* with respect to groove 311-*b*. Liquid then is forced through valve 325 and through the conduit 332 for discharge through nozzle 333.

Thus there has been disclosed and described as improvements advancing the art of liquid dispensers, an integral, compressible container pumping mechanism and with valving therefor, preferably in the form of a bellows pump. The dispenser, and in particular the pumping container or bellows is preferably fabricated of thermoplastic elastomeric materials and molding resins. The bellows comprises multiple flexible wall sections, pleats or corrugations that can repeatedly be flexed and unflexed with little or no loss of inherent elastic memory and, in a single part, combines the operations of a piston, a fluid chamber, a return spring and a valve. The bellows container pump can be constructed and fabricated in the configurations described, of thermoplastic elastomeric materials by any known process, a particularly preferred one being the well-known blow molding process. It has been discovered that by so doing, such a pump container can duplicate the tensile strength of a spring, allowing the same to be compressively stressed from the closed bottom end to reduce its length and the enclosed volume, and thereafter, due to its inherent elastic memory, recovering its original shape upon removal of the stress. Any of the well-known plastics can be used, a preferred one being pololefin, in particular, polyethylene. Another suitable material is a member of a family of polyolefin thermoplastic rubbers available to the art and sold under the trademark TPR, registered in the United States Patent and Trademark Office. Still others include, but are not limited to ethyl vinyl acetate, polypropylene, polyurethane, polyester elastomer, polyvinyl chloride and natural and synthetic rubber. In some instances, it is believed the invention may be of metal or metal in combination with plastic, and such combinations of materials are contemplated for use herein. Other materials and combinations will occur to the skilled artisan in carrying out the invention.

What is claimed is:

1. A hand held manually operable liquid dispenser comprising (a) a component retaining body having a pump chamber, an inlet port and an outlet port, said ports each having a connection to said pump chamber, (b) an actuatable compressible and expansible variable volume bellows defining said pump chamber, said bellows having an expanded condition when at rest, a closed end, an open end, and multiple flexible wall sections that define a portion at least of the volume of said pump chamber, said flexible wall sections having inherent elastic memory and being operative to return said bellows to its normal expanded state after actuation to its compressed state, compression and expansion of said bellows tending, respectively, to develop fluid pressures higher and lower than ambient pressure in said pump chamber, (c) a cavity located within the component retaining body, the depth of said cavity being substantially co-extensive with the length of said bellows in its expanded condition, said bellows being nested within said cavity, (d) pressure responsive valve means in said body associated with the open end of said bellows and operating in response to the pressure in said pump chamber selectively to control the flow of fluid through said inlet and outlet ports, opening said inlet port while maintaining said outlet port closed, and opening said outlet port while maintaining said inlet port closed, when the fluid pressure in said pump chamber is lower and higher, respectively, than the ambient pressure, thereby alternately causing fluid to be drawn from a source thereof through said inlet port into said pump chamber and discharged from said pump chamber through said outlet port.

2. A liquid dispenser as specified in claim 1 wherein said bellows is made of synthetic plastic and wherein said dispenser further includes operating means secured to said component retaining body for actuating said bellows between its expanded and compressed states.

3. A hand held manually operated liquid dispenser comprising (a) component retaining body means;

(b) a cavity located within said component retaining body means;

(c) a variable volume compressible and expansible bellows pump secured within said cavity and having an open end; said variable volume bellows pump having an expanded condition and in such expanded condition having a length substantially coextensive with the depth of said cavity;

(d) a hollow projection extending axially from an interior portion of said body means into said cavity and into the open end of said pump;

(e) inlet and outlet means disposed within said component retaining body means for delivering liquid into and out of said bellows pump;

(f) operating means, including a trigger secured to said component retaining body means for shifting said bellows pump from a normal, non-pumping position to a pumping position and including a plunger secured to said bellows pump, said plunger being shiftable within said cavity to compress said bellows pump; and (g) discharge means, communicating with said outlet means for dispensing liquid pumped by said bellows pump.

4. A manually operated liquid dispenser comprising (a) component retaining body means;

(b) a cavity located within the component retaining body means;

(c) a variable volume bellows pump having an open end and secured in the cavity by an annular clamping ring located on the exterior of the bellows pump;

(d) a retaining clip inserted into said cavity to engage the clamping ring and secure the bellows pump in fixed position within the cavity;

(e) a projection in the body means that extends a short distance into the cavity and that is adapted to accomodate the open end of the pump;

(f) inlet and outlet means disposed within the component retaining body means for delivering liquid into and out of the bellow pump;

(g) operating means, including a trigger secured to the component retaining body means for shifting the bellows pump from a normal, non-pumping position to a pumping position; and (h) discharge means, communicating with the outlet means for dispensing liquid pumped by the bellows pump.

5. A manually operated liquid dispenser comprising (a) component retaining body means;

(b) inlet means within said component retaining body means for admitting liquid thereinto;

(c) outlet means including a discharge orifice located at one end of said component retaining body means remote from said inlet means to dispense liquid therefrom;

(d) check valve means disposed within said body means to regulate the fluid flow from said inlet means to said outlet means;

(e) a cavity defined within the interior of said body means intermediate said inlet and outlet means and in communication therewith;

(f) a variable volume bellows pump secured within said cavity, the bellows pump having a sealed end, corrugated sidewalls and an open end having an edge, and having formed, at the open end edge a member that cooperates with an interior portion of the body to form an outlet valve therewith; and (g) operating means including a trigger secured to the component retaining body means for shifting the bellows pump from a normal, non-pumping position to a pumping position.

6. A manually operated liquid dispenser comprising (a) component retaining body means;

(b) inlet means within said component retaining body means for admitting liquid thereinto;

(c) outlet means including a discharge orifice located at one end of said component retaining body means remote from said inlet means to dispense liquid therefrom;

(d) check valve means disposed within said body means to regulate the fluid flow from said inlet means to said outlet means;

(e) a cavity defined within the interior of said body means intermediate said inlet and outlet means and in communication therewith;

(f) a variable volume bellows pump secured within said cavity, the bellows pump having a sealed end, corrugated sidewalls and an open end, and having formed, at the open end, a member that cooperates with an interior portion of the body to form an outlet valve therewith, said component retaining body means including a projection that extends a short distance into the cavity to accommodate the open end of the pump, the open end of the pump being formed with an inwardly projecting lip and normally engaging said projection to define a valve therebetween; and (g) operating means including a trigger secured to the component retaining body means for shifting the bellows pump from a normal, non-pumping position to a pumping position.

7. A manually operated liquid dispenser comprising (a) component retaining body means;

(b) inlet means within said component retaining body means for admitting liquid thereinto;

(c) outlet means including a discharge orifice located at one end of said component retaining body means remote from said inlet means to dispense liquid therefrom;

(d) check valve means disposed within said body means to regulate the fluid flow from said inlet means to said outlet means;

(e) a cavity defined within the interior of said body means intermediate said inlet and outlet means and in communication therewith;

(f) a variable volume bellows pump secured within said cavity, the bellows pump having a sealed end, corrugated sidewalls and an open end, and having formed, at the open end, a member that cooperates with an interior portion of the body to form an outlet valve therewith, said bellows pump including a clamping ring located on the exterior thereof, said ring being engaged by a retaining clip inserted in the cavity for securing said bellows pump in fixed position within the cavity; and (g) operating means including a trigger secured to the component retaining body means for shifting the bellows pump from a normal, non-pumping position to a pumping position.

8. A manually operated liquid dispenser comprising (a) component retaining body means;

(b) inlet means within said component retaining body means for admitting liquid thereinto;

(c) outlet means including a discharge orifice located at one end of said component retaining body means remote from said inlet means to dispense liquid therefrom;

(d) check valve means disposed within said body means to regulate the fluid flow from said inlet means to said outlet means;

(e) a cavity defined within the interior of said body means intermediate said inlet and outlet means and in communication therewith;

(f) a variable volume bellows pump secured within said cavity, said bellows pump having a closed end, an open end, and corrugated sidewalls having inherent elastic memory, and having formed, at the open end, a member that cooperates with an interior portion of the body to form an outlet valve therewith;

(g) operating means including a trigger secured to the component retaining body means for shifting the bellows pump from a normal, non-pumping position to a pumping position, the inherent elastic memory of the sidewalls of said bellows shifting the bellows from the pumping position to the normal, non-pumping position.

9. A dispenser according to claim 8 in which the component retaining body means includes a projection that extends a short distance into the cavity adapted to accommodate the open end of the pump.

10. A dispenser according to claim 9 in which the projection contains a check valve.

11. A dispenser according to claim 8 in which the operating means includes a plunger secured to the bellows pump that is shiftable within the cavity to compress the bellows pump.

12. A manually operated liquid dispenser comprising (a) component retaining body means;

(b) a cavity located within the component retaining body means, (c) a variable volume bellows pump secured within the cavity, the bellows pump having a closed end, an open end, and multiple flexible wall sections having inherent elastic memory;

(d) inlet and outlet means disposed within the component retaining body means, for delivering liquid into and out of the bellows pump, the outlet means including an outlet valve member and a valve seat for said member, the outlet valve member being integrally formed at the open end of the bellows pump, the valve seat being formed on an interior portion of the component retaining body means;

(e) operating means, including a trigger secured to the component retaining body means for shifting the bellows pump from a normal, non-pumping position to a pumping position, the inherent memory of said wall sections shifting the bellows pump from the pumping position to the non-pumping position; and (f) discharge means communicating with the outlet means for dispensing liquid pumped by the bellows pump.

13. A manually operated liquid dispenser comprising (a) a body member in or to which the other components of the dispenser are retained or secured;

(b) a cavity within said body member in which is secured a variable volume pump chamber constituted by a hollow resilient pump member that is adapted to be compressed and allowed to expand to an expanded condition and comprising a bellows member having a sealed end, flexible corrugated sidewalls, and an open end in engagement with said body member, the length of said pump member in its expanded condition being substantially coextensive with the depth of said cavity;

(c) inlet and outlet means in said body member for the delivery of liquid to and the discharge of liquid from said pump chamber;

(d) manual operating means including a trigger secured to said body member for compressing said bellows member to reduce the volume of said pump chamber; and (e) discharge means communicating with said outlet means for dispensing liquid pumped by said pump member.

14. A manually operated liquid dispenser comprising (a) a body member in or to which the other components of the dispenser are retained or secured;

(b) a cavity within the body member in which is secured a variable volume pump chamber constituted by a hollow resilient pump member adapted to be compressed and comprising a bellows member having a sealed end, flexible corrugated sidewalls, and an open end in engagement with said body member;

(c) a cup secured in said cavity, said cup having a wall with inner and outer wall surfaces, an open end, and a partially closed end having a slot formed therein, said bellows member being retained in said cup with the sealed end of said bellows member facing said partially closed end of said cup, (d) inlet and outlet means in said body member for the delivery of liquid to and the discharge of liquid from said pump chamber; (e) manual operating means including a trigger secured to the body member for compressing said bellows member to reduce the volume of said pump chamber, a trigger extension member extending through said slot in said partially closed end of said cup; and (f) discharge means communicating with said outlet means for dispensing liquid pumped by the pump member.

15. A manually operated liquid dispenser as specified in claim 14 including a disc in said cup upon which the closed end of said bellows member is supported, said disc having an edge in sliding engagement with said inner wall of said cup, an opening in a wall of said cavity, a passageway in said body member connecting said cavity wall opening to the air space of a container of a supply of liquid to be dispensed, an opening in the wall of said cup adjacent the said partially closed end thereof, and a groove in said outer wall surface of said cup leading from said cavity wall opening to said cup wall opening, said edge of said disc including spaced sealing elements for sealing said cup wall opening in a non-compressed position of said bellows member.

16. A manually operated liquid dispenser comprising (a) a body member in or to which the other components of the dispenser are retained or secured;

(b) a cavity within the body member in which is secured a variable volume pump chamber constituted by a hollow resilient pump member adapted to be compressed and comprising a bellows member having a sealed end, flexible corrugated sidewalls, and an open end in engagement with said body member, said bellows member including a flange member at said open end;

(c) inlet and outlet means in said body member for the delivery of liquid to and the discharge of liquid from said pump chamber; said inlet and outlet means each including a separate valve member and a separate valve seat for each member, said valve members each being integrally formed on said flange member, said valve seats being formed on an interior portion of said body member;

(d) manual operating means including a trigger secured to the body member for compressing said bellows member to reduce the volume of said pump chamber; and (e) discharge means communicating with said outlet means for dispensing liquid pumped by the pump member.

17. A manually operated liquid dispenser as specified in claim 16 including means connected to said trigger for venting during each compression of the pump member the air space of a container of the supply of liquid to be dispensed.

18. A hand held manually operable liquid dispenser, comprising a housing having an interior projection, an inlet, an outlet, an inlet valve, an outlet valve, and a compressible and expansible resilient bellows as a variable volume pump chamber, said bellows having a closed end and an open end having a resilient edge, said open end communicating with said inlet through said inlet valve and adapted to be brought into communication with said outlet through said outlet valve, said outlet valve being formed by said resilient open end edge of said bellows and a valve seat on said interior projection of the housing, the outer surface of which projection forms the valve seat and is surrounded by said end edge of said bellows, and said inlet valve being a check valve.

19. A manually operable liquid dispenser as specified in claim 18 wherein said inlet valve is a ball check valve housed in said projection.

20. A manually operable liquid dispenser as specified in claim 18 wherein the dispenser housing includes a cavity and said bellows includes an annular clamping ring located on the exterior wall thereof, and further including retaining means, said bellows being secured in said cavity by said retaining means inserted in said cavity to engage said clamping ring.

21. A manually operable liquid dispenser as specified in claim 20 wherein said clamping ring is located on the wall of said bellows at a position intermediate the ends thereof.

22. A hand held manually operable liquid dispenser as specified in claim 1 wherein said component retaining body includes a hollow projection that extends axially from an interior portion of said body into the open end of said bellows and wherein said pressure responsive means includes inlet means and outlet means communicating respectively with said inlet port and said outlet port, said inlet means and said outlet means each being formed in an interior portion of said component retaining body associated with said hollow projection and in communication with the open end of said bellows, each of said inlet means and said outlet means including a respectively associated inlet valve member and outle valve member and a valve seat for the associated valve member.

* * * * *